US012409989B2

(12) United States Patent
Wu et al.

(10) Patent No.: US 12,409,989 B2
(45) Date of Patent: Sep. 9, 2025

(54) CONTAINER COVER

(71) Applicant: WaterH Inc., Toronto (CA)

(72) Inventors: Xijin Wu, Shenzhen (CN); Xia Qu, Shenzhen (CN); Qi Wang, Shenzhen (CN)

(73) Assignee: WaterH Inc., Toronto (CA)

( * ) Notice: Subject to any disclaimer, the term of this patent is extended or adjusted under 35 U.S.C. 154(b) by 53 days.

(21) Appl. No.: 18/624,066

(22) Filed: Apr. 1, 2024

(65) Prior Publication Data

US 2025/0042631 A1 Feb. 6, 2025

(30) Foreign Application Priority Data

Jul. 31, 2023 (CN) ..... 202322039122.9

(51) Int. Cl.
*B65D 51/24* (2006.01)
*B65D 41/02* (2006.01)
*B65D 47/08* (2006.01)

(52) U.S. Cl.
CPC ..... *B65D 51/248* (2013.01); *B65D 41/02* (2013.01); *B65D 47/0895* (2013.01); *B65D 51/242* (2013.01); *B65D 51/245* (2013.01); *B65D 2251/0025* (2013.01); *B65D 2251/0078* (2013.01); *B65D 2251/1033* (2013.01)

(58) Field of Classification Search
CPC ..... G01C 9/18; G01C 9/04; A47G 19/2272; A47G 23/16; A47G 19/2227; A47G 2019/2238; A47G 2019/2244; B67D 3/0051; B65D 51/248; B65D 41/02; B65D 47/0895; B65D 51/242; B65D 51/245; B65D 2251/0025; B65D 2251/0078; B65D 2251/1033
See application file for complete search history.

(56) References Cited

U.S. PATENT DOCUMENTS

| | | | | |
|---|---|---|---|---|
| 9,320,375 | B2 * | 4/2016 | Sweeney | A61B 5/024 |
| 9,327,960 | B2 * | 5/2016 | Sweeney | G01B 21/22 |
| 10,829,275 | B2 * | 11/2020 | Owusu | A45F 3/18 |
| 2012/0312031 | A1 * | 12/2012 | Olsen | A47J 41/02 220/592.27 |
| 2014/0319170 | A1 * | 10/2014 | Sweeney | A47G 19/2272 220/714 |
| 2015/0122688 | A1 * | 5/2015 | Dias | A47G 19/027 206/459.1 |
| 2015/0259105 | A1 * | 9/2015 | Martinez | B65D 39/0052 220/233 |

* cited by examiner

*Primary Examiner* — Kareen K Thomas
(74) *Attorney, Agent, or Firm* — Li & Cai Intellectual Property Office

(57) ABSTRACT

A container cover relating the technical field of smart water cups is provided. The container cover includes a cover body provided with a drinking water passage, wherein an upper side of the drinking water passage is a drinking port; a cover cap provided on an upper side of the cover body; an inner cover provided on a lower side of the cover body, wherein a water outlet connected to the drinking water passage is provided in the inner cover, and a sealed accommodation cavity is formed between the inner cover and the cover body; a cover opening transducer provided between the cover body and the cover cap; and a flow sensing transducer, an orientation transducer, a power supply module, and a control circuit board provided in the sealed accommodation cavity.

10 Claims, 10 Drawing Sheets

A-A

CONTAINER COVER

FIELD OF THE DISCLOSURE

The present disclosure relates to the technical field of smart water cups, and more particularly to a container cover.

BACKGROUND OF THE DISCLOSURE

Containers are commonly used daily necessities and mainly used to hold water, including various drinks. With the diversification of people's needs, various requirements have been put forward for the functions of containers, such as setting handles on the containers, which has a good anti-scalding effect. If a cup lid is provided, the water and other liquid contained inside can prevent heat dissipation to achieve the purpose of heat preservation. The material can be plastic, ceramic or stainless steel, etc. With the development of intelligent technology, the functions of containers have been continuously expanded.

As more awareness of drinking water for health, the user needs more intelligent management of the use of containers. For example, the user needs to be informed of the volume of liquid poured out of the container in a timely manner, and the flow management of container pouring water, etc.

However, most of the conventional measurement solutions for water flow in containers are arranged on the container, which makes the production of the container extremely complicated. In addition, each time the container is cleaned, it will also cause erroneous monitoring data. The few container cover caps that can measure water flow mostly use water level sensors, which cannot accurately identify and determine the user's drinking water volume, let alone give users drinking water reminders.

SUMMARY OF THE DISCLOSURE

The purpose of the present disclosure is to provide a container cover in view of the defects and shortcomings of the existing technology, which has the advantage of being able to accurately identify and determine the user's drinking water amount and give the user a drinking water reminder.

In order to achieve the aforementioned purpose, the technical solution adopted by the present disclosure is to provide a container cover, including a cover body provided with a drinking water passage, in which an upper side of the drinking water passage is a drinking port; a cover cap covering an upper side of the cover body; an inner cover provided on a lower side of an interior of the cover body, in which a water outlet spatially communicated with the drinking water passage is provided in the inner cover, and a sealed accommodation cavity is provided between the inner cover and the cover body; a cover opening transducer provided between the cover body and the cover cap, and configured to sense whether the cover cap is open; a flow sensing transducer provided in the sealed accommodation cavity and corresponding to the drinking water passage, and configured to sense whether or not water reaches the drinking water passage; an orientation transducer provided in the sealed accommodation cavity and configured to sense a tilt angle of the container cover when drinking water; a reminder device provided on the container cover and configured to remind a user to drink water when insufficient water is taken in; a power supply module provided in the sealed accommodation cavity; and a control circuit board provided in the sealed accommodation cavity, and correspondingly and electrically connected to the cover opening transducer, the flow sensing transducer, the orientation transducer, the reminder device and the control circuit board, and provided with a water consumed value.

Further, a lower edge of the inner cover protrudes outward and is arranged on a lower side of the cover body. The inner cover is made of a light-conducting material or a material added with light-conducting powder. The reminder device includes a plurality of lamp beads provided in the sealed accommodation cavity, the plurality of lamp beads are electrically connected to the control circuit board, and have light-emitting directions facing the cover body. The plurality of lamp beads are arranged in a circular pattern.

Further, the inner cover is made of any one of PMMA, PS, PC, PP and AS.

Further, the reminder device is a sound device or a vibration device.

Further, the cover cap is rotatably connected to one end of the cover body, and a button-type locking switch structure is provided on the cover cap and another end of the cover body.

Further, the container cover further includes a U-shaped handle, one end of the U-shaped handle is rotatably connected to the cover cap or the cover body, and when the U-shaped handle falls freely, another end of the U-shaped handle blocks the button-type locking switch structure.

Further, a protruding point is correspondingly provided on two sides of the cover cap, and when the U-shaped handle falls freely, the protruding points are respectively arranged above two connecting arms of the U-shaped handle to prevent the U-shaped handle from rotating upward.

Further, the flow sensing transducer is a metal conductive film attached to an outer wall of the drinking water passage and configured to sense whether or not the water reaches the drinking water passage; the orientation transducer is a three-axis acceleration sensor and configured to sense the tilt angle of the container cover when drinking water; and the cover opening transducer is a photoelectric switch, a pressure switch, an electromagnetic switch or a contact sensor, and is configured to sense whether or not the cover cap is opened.

Further, a display screen electrically connected to the control circuit board is provided on an outer wall of the cover body, and when drinking water is completed, the display screen is configured to display an amount of water consumed by the user.

Further, a wireless communication module connected to the control circuit board is provided in the sealed accommodation cavity, and the wireless communication module is configured to implement data transmission with an APP.

By adopting the above technical solution, the beneficial effects of the present disclosure are as follows. In the present disclosure, the flow sensing transducer and the orientation transducer are provided in the sealed accommodation cavity, and the cover opening transducer is provided between the cover body and the cover cap, so that when the user drinks water, the flow sensing transducer can sense the water when the water first reaches the drinking water passage. By reading the value of the orientation transducer at this time, the tilt angle of the container cover at this time can be obtained. Through the tilt angle, the actual amount of water in the cup body can be known. In addition, the cover opening transducer determines whether or not the cover cap is open, and determines whether there is water flowing out of the drinking port, thereby determining whether it is a real drinking action. Each time the user drinks water, the angle when the water first reaches the drinking water passage is different, so that the actual amount of water consumed can be calculated. Further, by providing the reminder device, when the set drinking time comes, it will confirm whether the amount of water consumed by the user is enough. If it is insufficient, the reminder device will remind the user to drink water.

BRIEF DESCRIPTION OF THE DRAWINGS

In order to explain the embodiments of the present disclosure or the technical solutions in the prior art more clearly, the drawings needed to be used in the description of the embodiments or the prior art will be briefly introduced below. Obviously, the drawings in the following description are only some embodiments of the present disclosure. For those of ordinary skill in the art, other drawings can be obtained based on these drawings without exerting any creative effort.

Figure 1:
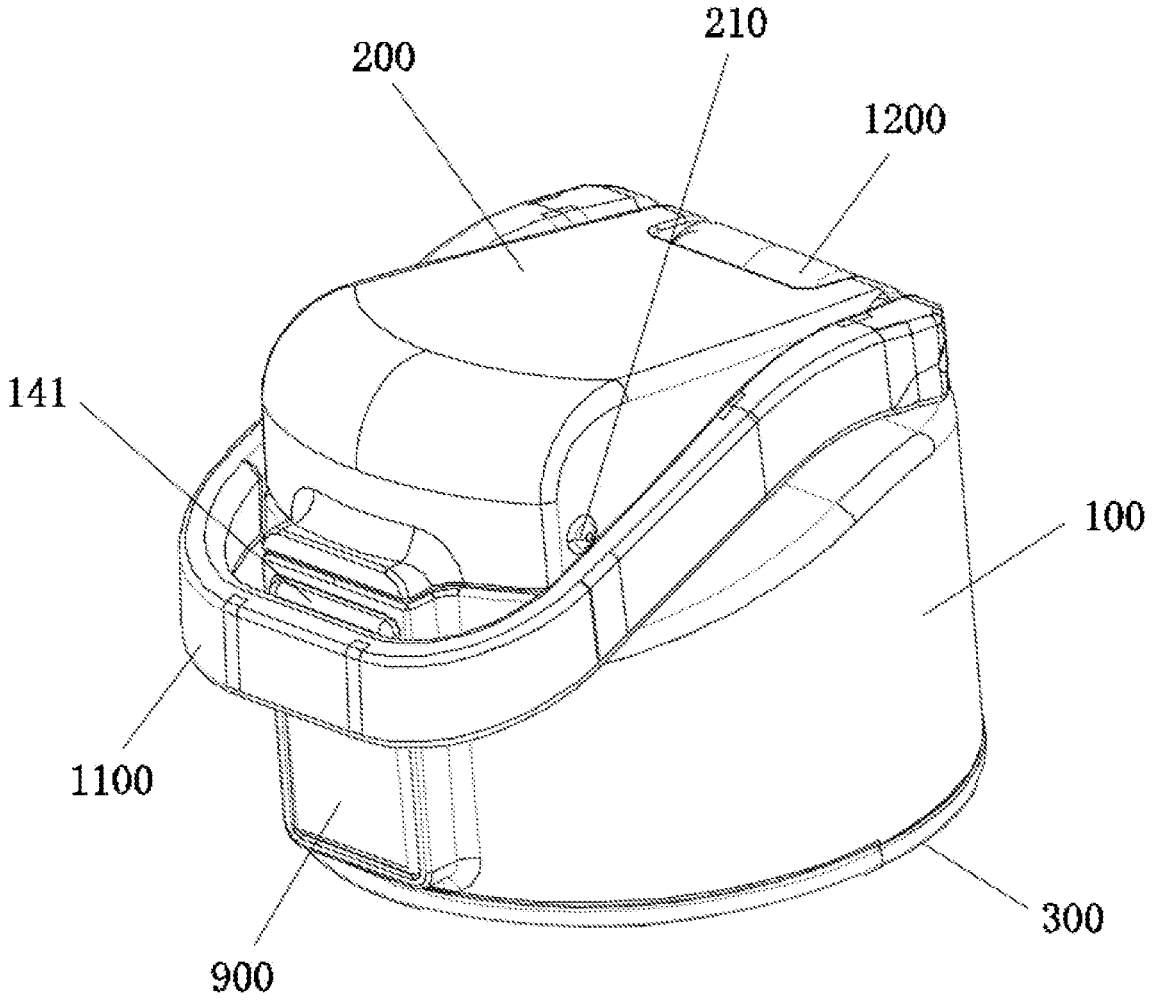
FIG. 1 is a schematic structural diagram of a container cover.

Reference numeral: 1, container cover; 100, cover body; 110, drinking water passage; 120, drinking port; 130, sealed accommodation cavity; 140, button-type locking switch structure; 141, button; 200, cover cap; 210, protruding point; 220, protruding block; 300, inner cover; 310, water outlet; 400, cover opening transducer; 500, flow sensing transducer; 600, orientation transducer; 700, control circuit board; 710, lamp bead; 800, power supply module; 810, battery; 820, charging interface device; 900, display screen; 1000, wireless communication module; 1100, U-shaped handle; 1110, groove; 1200, rotating shaft; 2, cup body.

DETAILED DESCRIPTION OF THE EXEMPLARY EMBODIMENTS

The present disclosure will be further described in detail below in conjunction with the accompanying drawings.

This specific embodiment is only an explanation of the present disclosure, and it is not a limitation of the present disclosure. Those skilled in the art can make modifications to this embodiment without creative contribution as needed after reading this specification, as long as the disclosure is protected by patent law within the scope of their claims.

Referring to FIG. 1 to FIG. 8, the present embodiment relates to a container cover 1, which includes a cover body 100 and a cover cap 200, and an inner cover 300. The cover body 100 is provided with a drinking water passage 110, and an upper side of the drinking water passage 110 is a drinking port 120. The cover cap 200 covers an upper side of the cover body 100, and is configured to open or close the drinking port 120. The inner cover 300 is provided on a lower side of the cover body 100 and provided with a water outlet 310 spatially communicated with the drinking water passage 110, and a sealed accommodation cavity 130 is defined between the inner cover 300 and the cover body 100. When the container cover 1 and the cup body 2 are assembled, the inner cover 300 is placed on the cup body 2. Specifically, in the present embodiment, the cover body 100 is rotatably connected to one end of the cover cap 200, and a button-type locking switch structure 140 is correspondingly provided on the cover body 100 and another end of the cover cap 200. The button-type locking switch structure 140 is a conventional structure, which is briefly described here. A free end of the cover body 100 is provided with an installation groove along a radial direction, and a button 141 is installed in the installation groove through a return spring. An insertion hole is provided on an upper end of the installation groove, and the button 141 is provided with a hook portion corresponding to a position of the insertion hole. A free end of the cover cap 200 is provided with a plug-in portion, and the plug-in portion is provided with a plug hole or slot corresponding to the plug-in portion.

Figure 5:
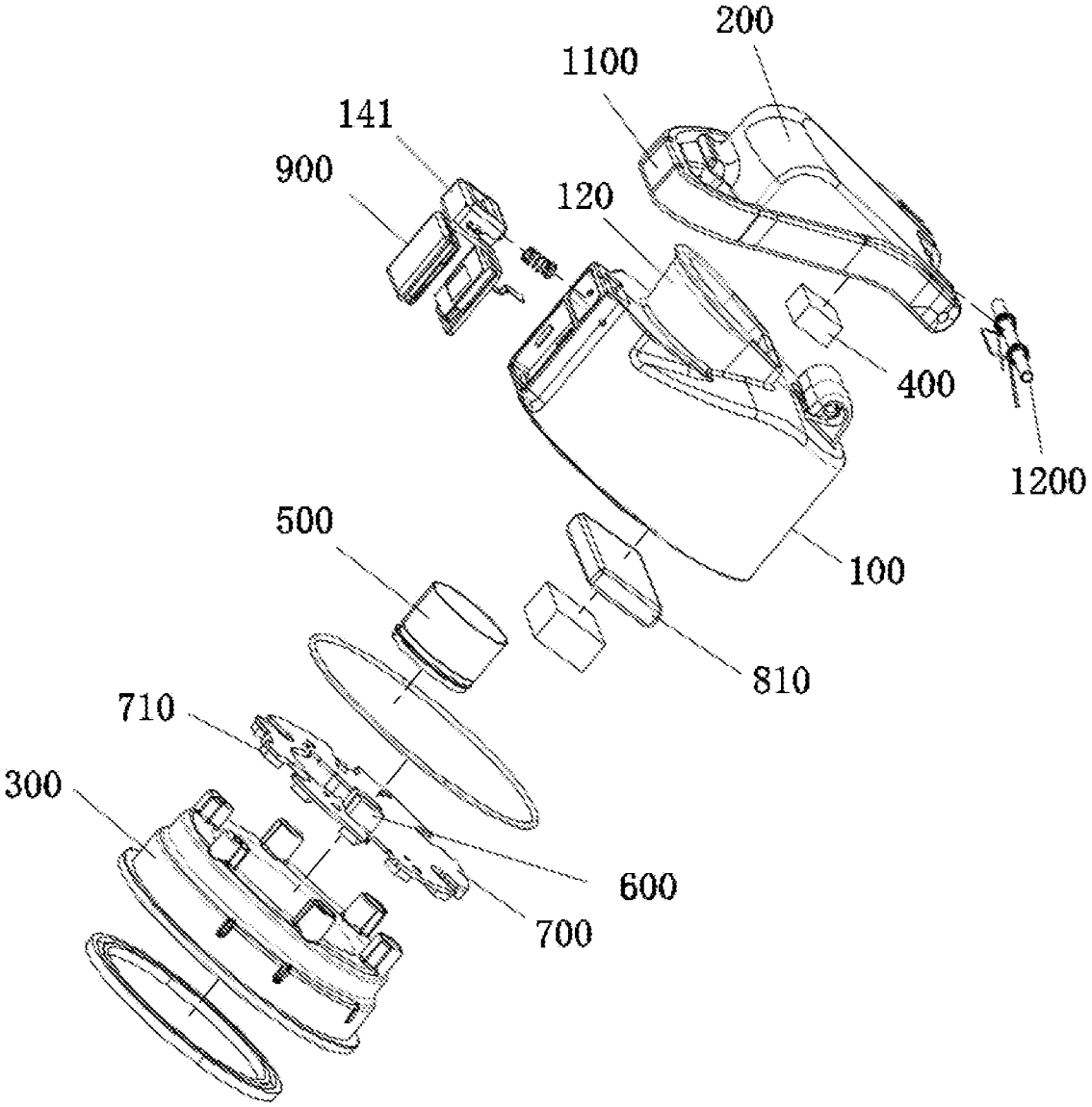
FIG. 5 is a schematic exploded diagram of the container cover.
Figure 6:
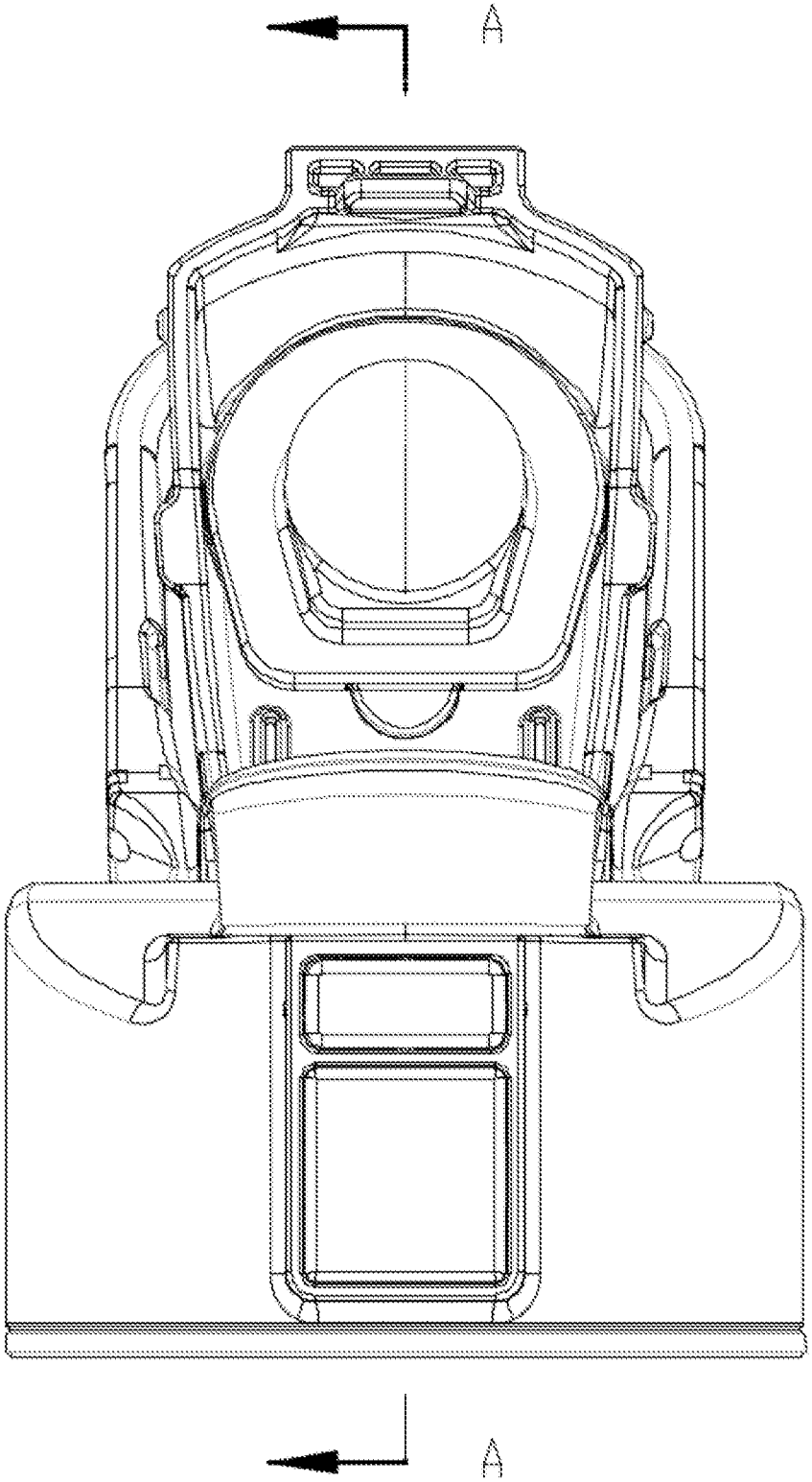
FIG. 6 is a front view of the container cover with the cover cap opened.
Figure 7:
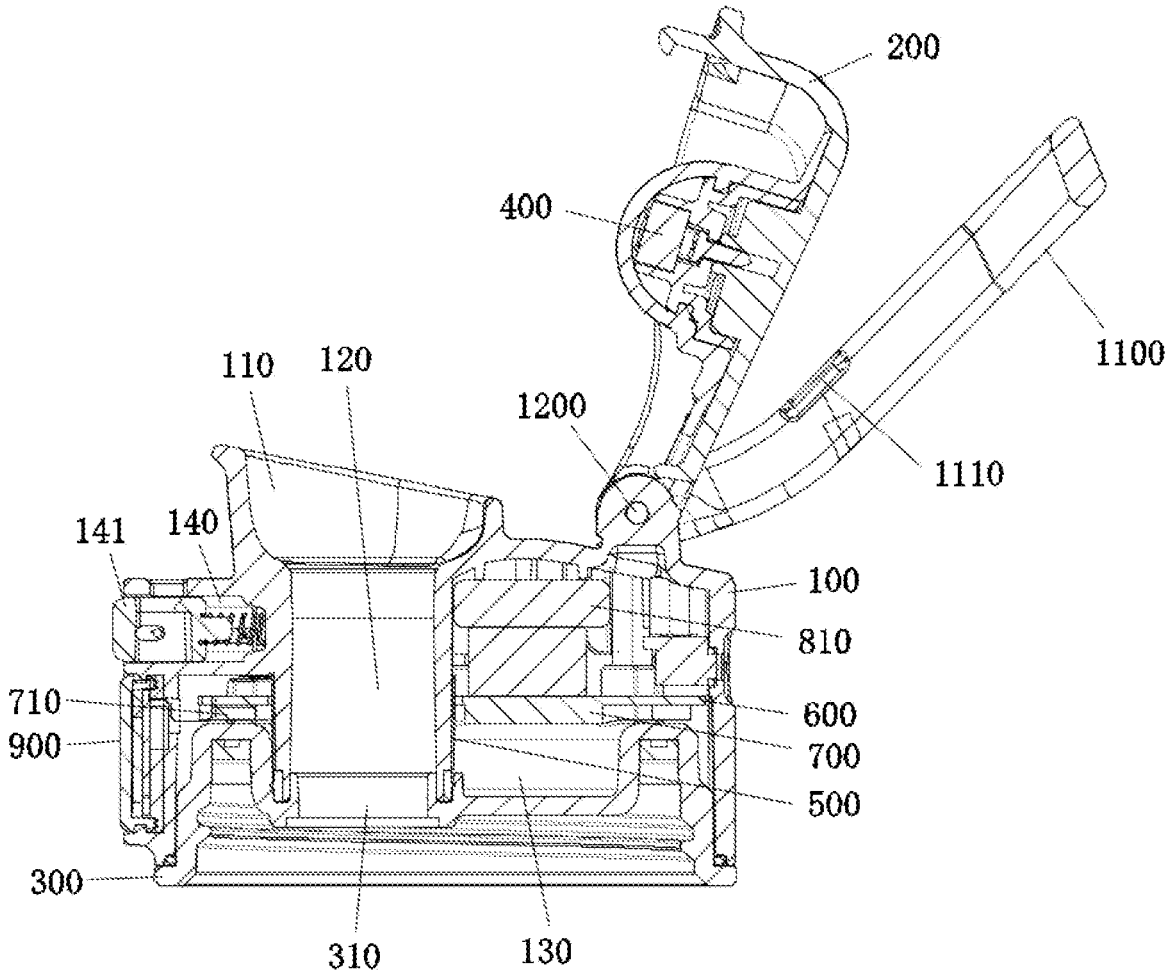
FIG. 7 is a cross-sectional view taken along A-A direction in FIG. 6.
Figure 8:
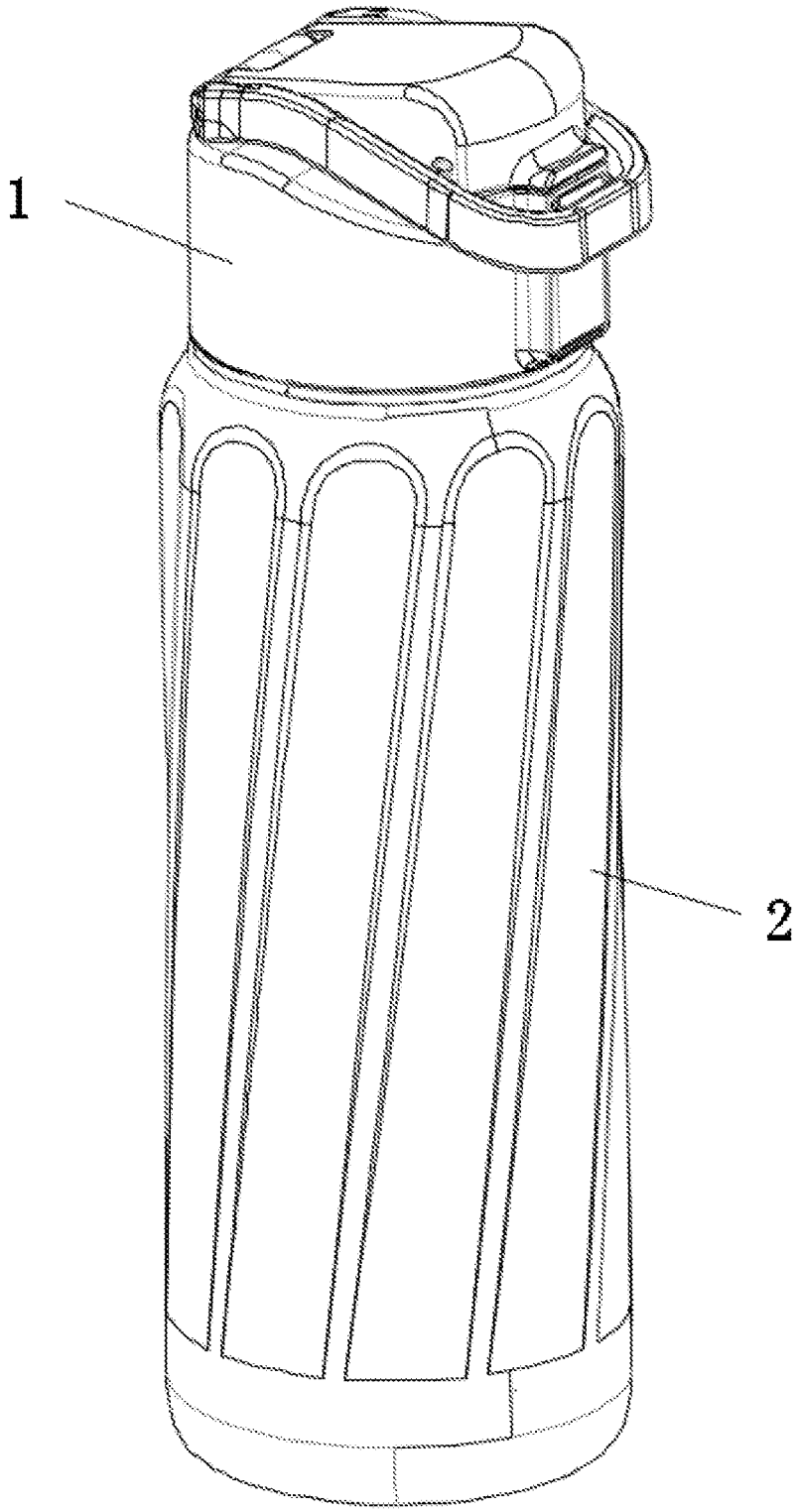
FIG. 8 is a schematic structural diagram of the container cover and a cup body.
Figure 9:
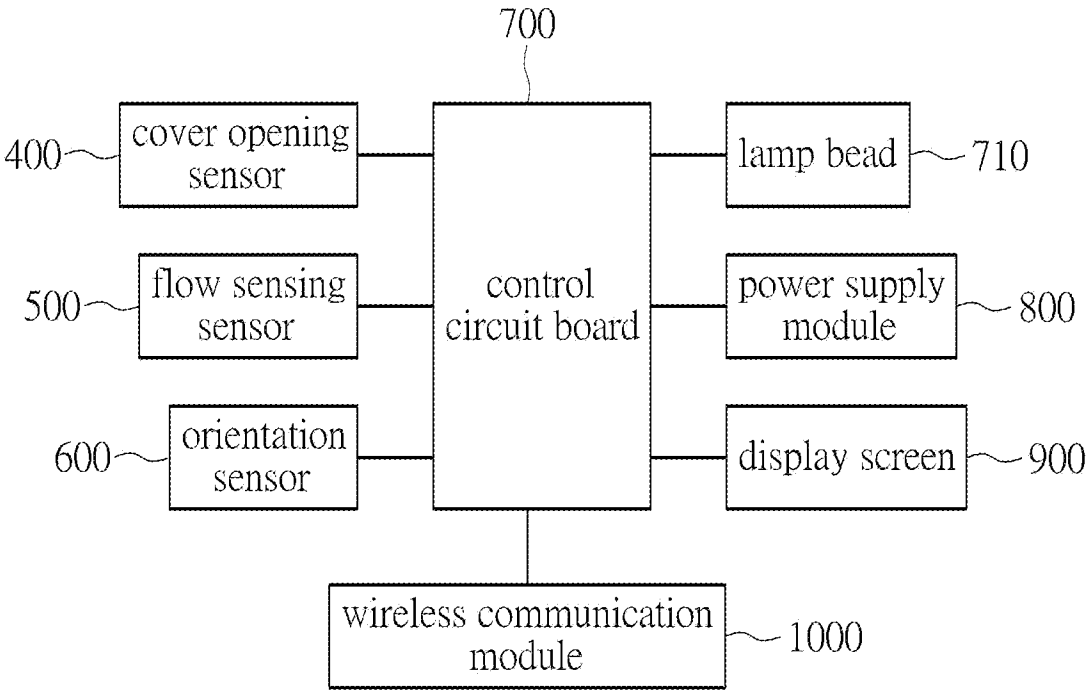
FIG. 9 is a structural block diagram of a control system for sensing a drinking water volume of the container cover.

Referring to FIGS. 5, 7, and 9, a cover opening transducer 400 is provided between the cover body 100 and the cover cap 200, and a flow sensing transducer 500, an orientation transducer 600, a power supply module 800, and a control circuit board 700 are correspondingly provided in the sealed accommodation cavity 130. The container cover 1 is provided with a reminder device. The flow sensing transducer 500 is configured to sense whether or not the liquid reaches the drinking water passage 110. The orientation transducer 600 is configured to sense a tilt angle of the container cover 1 when drinking water. The reminder device is configured to remind a user to drink water when insufficient water is taken in. The power supply module 800 is configured to supply power to each transducer. The control circuit board 700 is correspondingly and electrically connected to the cover opening transducer 400, the flow sensing transducer 500, the orientation transducer 600, and the reminder device, and is provided with a water consumed value.

By means of the cover opening transducer 400, the flow sensing transducer 500 and the matching orientation transducer 600, the user's drinking water amount can be accurately identified and determined. In addition, because a reminder device is provided, when the set drinking time comes, it will be confirmed whether the user's drinking water is enough. If the user's drinking water is insufficient, the reminder device will remind the user to drink water.

As shown in FIG. 1 to FIG. 7, a lower edge of the inner cover 300 protrudes outward and is located on the lower side of the cover body 100, and the inner cover 300 is made of a light-guiding material, such as any of PMMA, PS, PC, PP and AS. The PMMA, PS, PC, PP and AS referred to in the present embodiment are all food-grade materials and are harmless to the human body. In the present embodiment, the reminder device includes a plurality of lamp beads 710 provided in the sealed accommodation cavity 130, electrically connected to the control circuit board 700, and having a light-emitting direction facing the cover body 100 and a circumferential arrangement. More specifically, the plurality of lamp beads 710 are disposed on the control circuit board 700 and located below the control circuit board 700.

Lights emitted by the plurality of lamp beads 710 are refracted and form a light circle at the lower edge of the inner cover 300, which serves as a reminder. When the set drinking time comes, the container cover 1 is configured to confirm whether or not sufficient water is taken in by the user. If insufficient water is taken in, the plurality of lamp beads 710 will light up to remind the user to drink water. In the present embodiment, the inner cover 300 is provided with internal threads for screwing on the cup body 2, and an arrangement of the internal threads helps to enhance the light refraction effect of the inner cover 300.

The inner cover 300 is further made of a transparent material or a translucent material. In other embodiments, the inner cover 300 can also be made of a material added with light-conducting powder. The light-conducting powder is a food-grade additive and is harmless to the human body. In other embodiments, the reminder device can also be a sound-emitting device or a vibration device, specifically a horn or a vibration motor, which also has reminder properties.

Figure 2:
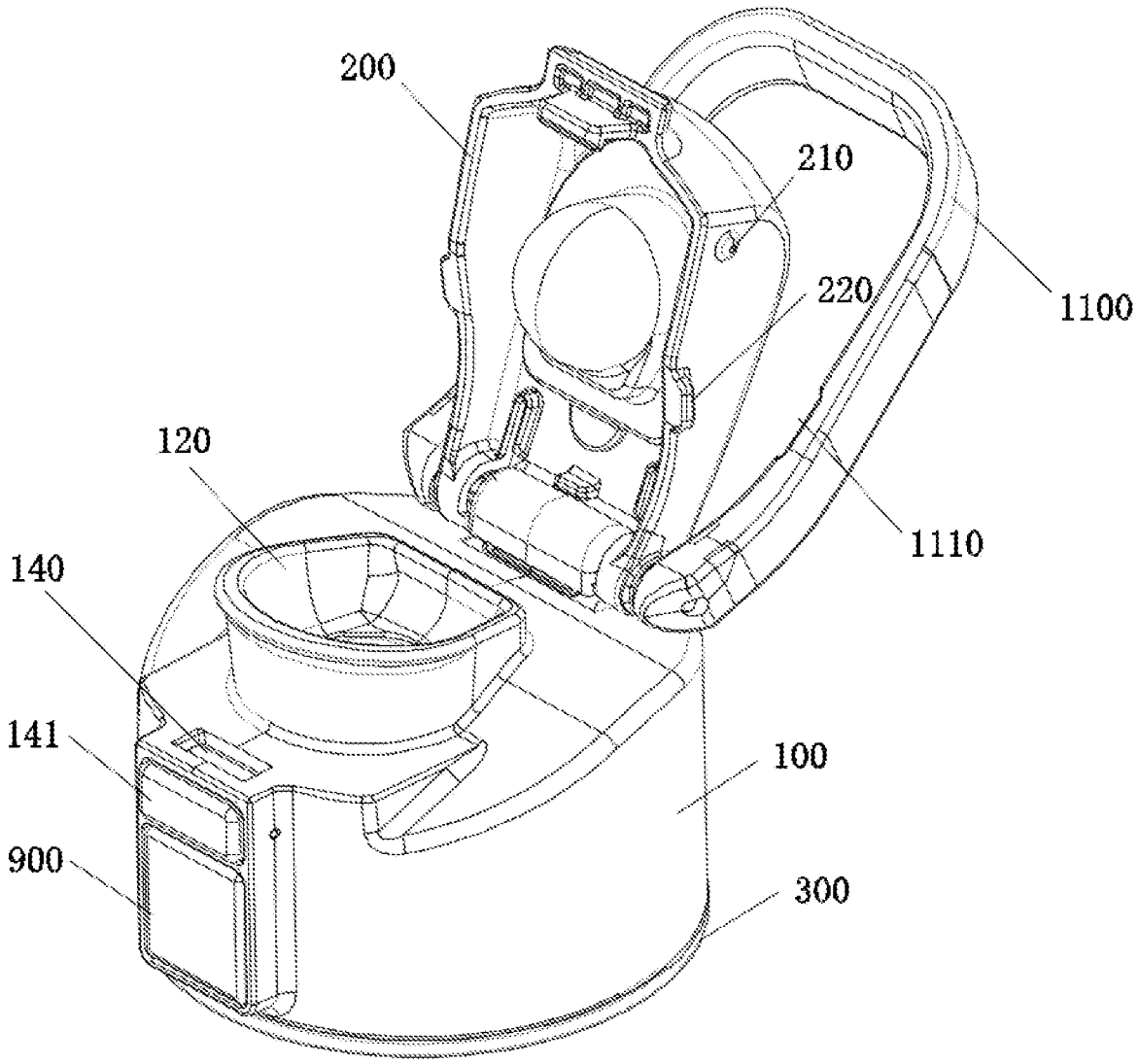
FIG. 2 is a schematic structural diagram of the container cover with the cover cap opened.
Figure 3:
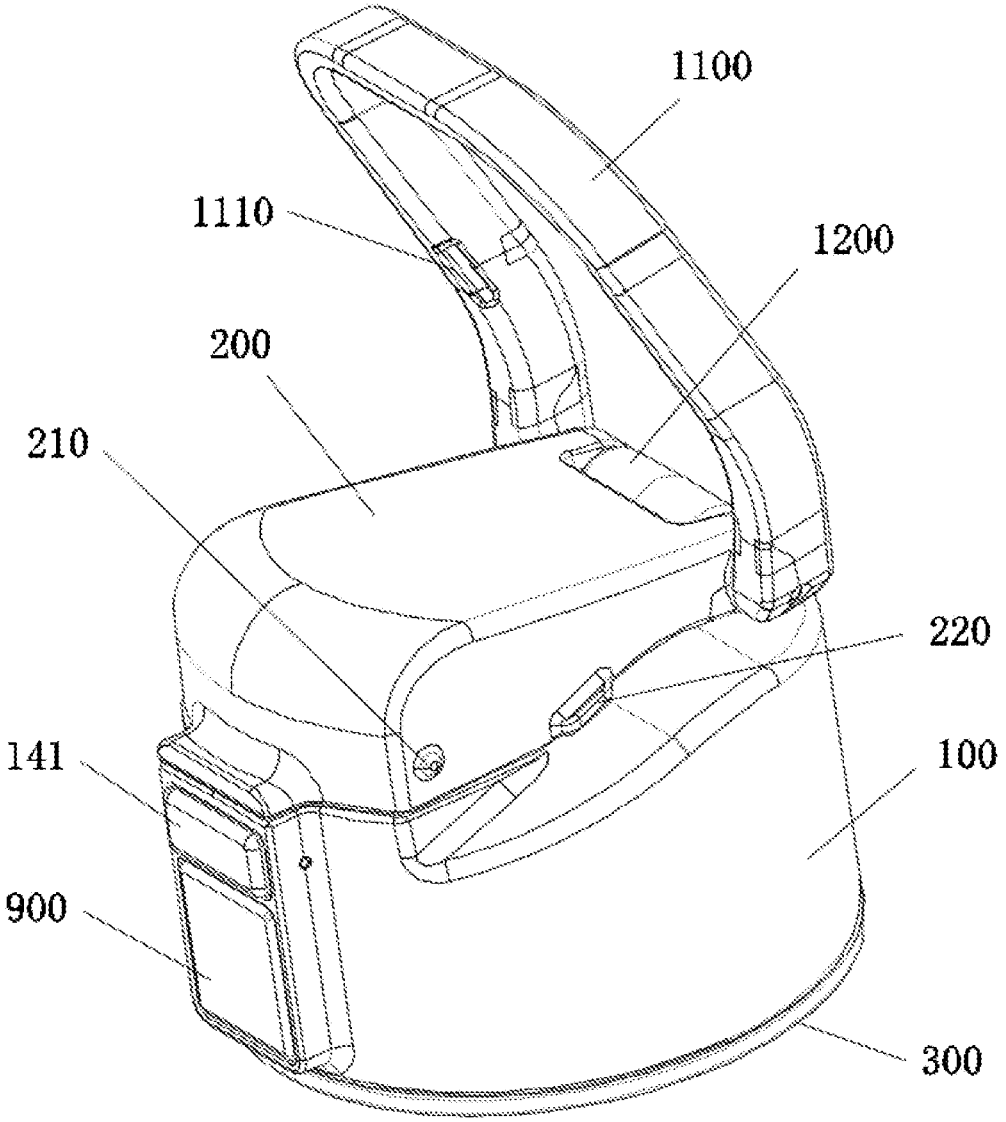
FIG. 3 is a schematic structural diagram of a U-shaped handle in the container cover being opened.

Referring to FIG. 1 to FIG. 3, in the present embodiment, the container cover 1 also includes a U-shaped handle 1100. The cover body 100, the cover cap 200 and the U-shaped handle 1100 are all rotationally connected and share the same rotating shaft 1200. When the U-shaped handle 1100 falls freely, its U-shaped end blocks the button-type locking switch structure 140, which can avoid accidentally touching the button 141, causing the cover cap 200 to open, leaking water, etc.

As a preferred solution, as shown in FIGS. 1 to 3, a protruding point 210 is correspondingly provided on both sides of the cover cap 200. When the U-shaped handle 1100 falls freely, the protruding points 210 are respectively arranged above two connecting arms of the U-shaped handle 1100 to prevent the U-shaped handle 1100 from rotating upward. The setting of the protruding point 210 can prevent the U-shaped handle 1100 from being thrown upward and accidentally touching the button 141. Only the user can open it with a little force. A damping feeling is generated through the protruding point 210 when the U-shaped handle 1100 is opened and closed. In addition, when the U-shaped handle 1100 is opened, the user can then open the cover body 200, the protruding point 210 on the cover cap 200 will block the U-shaped handle 1100 at a back, so that the U-shaped handle 1100 will not affect the user's normal drinking water.

On this basis, as shown in FIGS. 2 and 3, a groove 1110 is correspondingly provided on an inside of the two connecting arms of the U-shaped handle 1100, and a protruding block 220 corresponding to the protruding point 210 and located on the lower side of the protruding point 210 is correspondingly provided on both sides of the cover cap 200. The cooperation between the protruding blocks 220 and the grooves 1110 can assist the protruding points 210 to further prevent the U-shaped handle 1100 from being thrown upward and prevent the button 141 from being accidentally touched.

Specifically, the flow sensing transducer 500 is a metal conductive film attached to an outer wall of the drinking water passage 110. The metal conductive film is connected to a capacitance detection device connected to the control circuit board 700, and is configured to sense whether the liquid reaches the drinking water passage 110. The capacitance detection device consists of a mutual cover capacitance sensor, which uses a pair of pins. One of the pins acts as a transmitter (TX) and the other of the pins acts as a receiver (RX). This method measures the cover capacitance between the pins, that is, mutual cover capacitance. The liquid causes changes in mutual cover capacitance, and the degree of change depends on the flow rate or liquid level. The transmitter and receiver of the transducer are located on the metallic conductive film, and the liquid can change the mutual cover capacitance between the pins.

Specifically, the orientation transducer 600 is a three-axis acceleration sensor, and configured to sense the tilt angle of the cup body 2/the container cover 1 when drinking water. In the present embodiment, the orientation transducer 600 is directly provided on the control circuit board 700. The cover opening transducer 400 is any one of a photoelectric switch, a pressure switch, an electromagnetic switch and a contact sensor, and is configured to sense whether or not the cover body 200 is opened.

Figure 10:
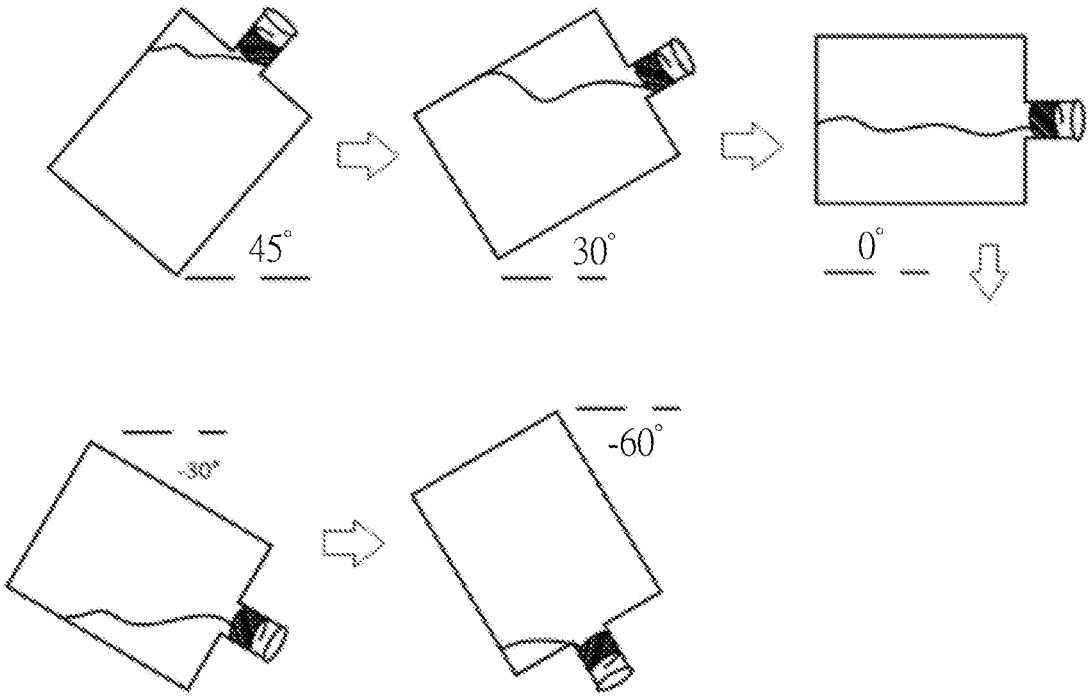
FIG. 10 a schematic diagram of a water quantity identification principle of the container cover.

When the user drinks water, the metal conductive film will sense the water when the water in the cup body 2 has just reached the drinking water passage 110. By reading a three-axis acceleration sensor value at this time, the tilt angle of the cup body 2/the container cover 1 can be obtained. The actual amount of water in cup body 2 can be known through the tilt angle (as shown in FIG. 10). At the same time, by using the cover opening transducer 400 to determine whether or not the cover cap 200 is open, it can be determined whether water flows out of the drinking port 120, thereby determining whether or not it is an actual drinking action. Each time the user drinks water, the angle when the water first reaches the drinking water passage 110 is different, so the an actual amount of water consumed by the user can be calculated. Therefore, the following three conditions must be met to determine the drinking action: (1) water is detected in the drinking water passage 110; (2) the cover cap 200 is opened, and if the cover cap 200 is not opened, although (1) conditions are met, it will not be determined as the drinking action; (3) the tilt angle of cup body 2/the container cover 1 is greater than a predetermined value.

According to the above principle, only the last water consumption can be determined each time, so it is necessary to predict the current water consumption.

The last water consumption volume is defined as Lo, this time water consumption volume is defined as Li, this time predicted water consumption volume is defined as Lp, and the last actual water consumption volume is defined as Lx.

$$Lr = (Lx - Lo) * P1 + Lp * P2.$$

P1 and P2 are different sizes depending on each drinking action.

The last actual water consumption volume Lx is calculated according to the above water consumption calculation principle. The predicted water consumption volume Lp this time is based on a preliminary estimate based on the speed and amplitude of the current drinking water angle.

Optionally, an action recognition device is integrated on the control circuit board 700 to supplement the determination of the user's drinking action. Specifically, the action recognition device at least includes a gravity sensor, a feature extraction unit and a drinking recognition unit. The gravity sensor is configured to obtain the acceleration change parameters when the user drinks water. The feature extraction unit is configured to process and analyze the acceleration change parameters, obtain the characteristics of the user's drinking water, establish a benchmark model and store it. The drinking water identification unit is configured to compare the real-time acceleration change parameters obtained by the gravity sensor with the stored reference model to identify the user's drinking action. Because a spatial position of the container cover 1 is constantly changing, such as pouring, carrying, and washing, in order to accurately obtain the user's drinking water amount, it is necessary to determine whether the user is drinking water, thereby correcting the detection parameters of the water level detection sensor. G-Sensor, also known as acceleration sensor, is configured to sense changes in acceleration, which is represented by an acceleration component in a three-dimensional direction. G-Sensor is configured in many smart devices. For example, IBM's high-end laptops have a built-in G-Sensor. When a violent pull occurs (such as a falling), hard drive protection is immediately activated to avoid hard drive damage. Another example is Apple's iPhone, which uses G-Sensor to sense the direction of the phone's screen. When the phone is placed horizontally while playing a video, the screen automatically rotates, so that the user experience can be greatly enhanced.

The gravity sensor can also be an attitude sensor, which is a high-performance three-dimensional motion attitude measurement system based on MEMS technology. It contains motion sensors such as a three-axis gyroscope, a three-axis accelerometer, and a three-axis electronic compass. It obtains temperature-compensated three-dimensional attitude and orientation data through the embedded low-power ARM processor. Using quaternion-based three-dimensional algorithms and special data fusion technology, zero-drift three-dimensional attitude and orientation data expressed in quaternions and Euler angles are output in real time. LPMS series and iAHRS-M0 attitude sensors can be widely embedded in model aircraft drones, robots, mechanical pan/tilts, vehicles and ships, ground and underwater equipment, virtual reality, human motion analysis and other products and equipment that require independent measurement of three-dimensional attitude and orientation.

Referring to FIG. 1 to FIG. 3, in the present embodiment, the outer wall of the cover body 100 is provided with a display screen 900 electrically connected to the control circuit board 700. When drinking water is completed, the amount of water consumed by the user is displayed on the display screen 900.

Referring to FIG. 9, in the present embodiment, a wireless communication module 1000 connected to the control circuit board 700 is provided in the sealed accommodation cavity 130. The wireless communication module 1000 and an APP implement data transmission. The wireless communication module 1000 implements data communication with the mobile terminal and can be connected to a cloud server through the mobile terminal, or directly connected to the cloud server. The wireless communication module 1000 mainly implements data transmission with an APP, and transmits the drinking water quality safety parameters and drinking water consumption volume information to the APP through the communication module, so that the safety status of the drinking water can be recorded and viewed at any time. The wireless communication module 1000 includes Bluetooth®, ZIGBEE, WIFI, LORA, NB-IOT and other wireless communication methods.

Figure 4:
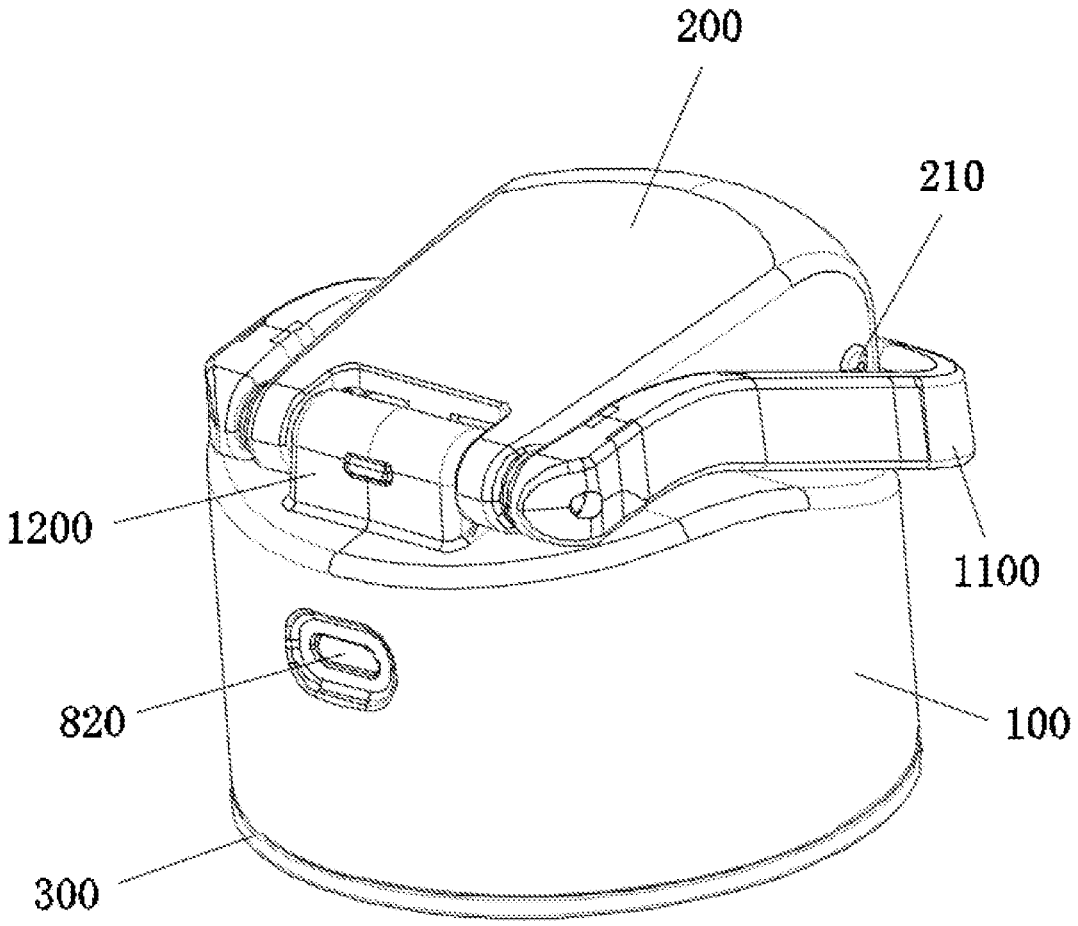
FIG. 4 is a schematic structural diagram of the container cover from another perspective.

In the present embodiment, as shown in FIGS. 4 and 5, the power supply module 800 includes a battery 810 and a charging interface device 820.

In the present example, a plurality of sealing rings are provided, such as screw sealing silicone rings, water passage sealing silicone rings, cover body 100 and inner cover 300 sealing silicone rings, container sealing silicone rings, etc.

The working principle of the disclosure is substantially as follows. The cover opening transducer 400, the flow sensing transducer 500 and the matching orientation transducer 600 can accurately identify and determine the amount of water consumed by the user. When the set drinking time comes, it will confirm whether or not sufficient water is taken in by the user. If the user's drinking water is insufficient, the reminder device will remind the user to drink water.

The above is only used to illustrate the technical solution of the present disclosure and not to limit it. Other modifications or equivalent substitutions made by those of ordinary skill in the art to the technical solution of the present disclosure can be made. As long as they do not deviate from the spirit and scope of the technical solutions of the present disclosure, they should be covered by the claims of the present disclosure.

What is claimed is:

1. A container cover, comprising:

a cover body (100) provided with a drinking water passage (110), wherein an upper side of the drinking water passage (110) is a drinking port (120);

a cover cap (200) covering an upper side of the cover body (100);

an inner cover (300) provided on a lower side of an interior of the cover body (100), wherein a water outlet (310) spatially communicated with the drinking water passage (110) is provided in the inner cover (300), and a sealed accommodation cavity (130) is provided between the inner cover (300) and the cover body (100);

a cover opening transducer (400) provided between the cover body (100) and the cover cap (200), and configured to sense whether or not the cover cap (200) is open;

a flow sensing transducer (500) provided in the sealed accommodation cavity (130) and corresponding to the drinking water passage (110), and configured to sense whether or not water reaches the drinking water passage (110);

an orientation transducer (600) provided in the sealed accommodation cavity (130) and configured to sense a tilt angle of the container cover (1) when drinking water;

a reminder device provided on the container cover (1) and configured to remind a user to drink water when insufficient water is taken in;

a power supply module (800) provided in the sealed accommodation cavity (130); and a control circuit board (700) provided in the sealed accommodation cavity (130) and correspondingly and electrically connected to the cover opening transducer (400), the flow sensing transducer (500), the orientation transducer (600), the reminder device and the control circuit board (700), and provided with a water consumed value.

2. The container cover according to claim 1, wherein a lower edge of the inner cover (300) protrudes outward and is arranged on a lower side of the cover body (100); the inner cover (300) is made of a light-conducting material or a material added with light-conducting powder; wherein the reminder device includes a plurality of lamp beads (710) provided in the sealed accommodation cavity (130), the plurality of lamp beads (710) are electrically connected to the control circuit board (700) and have light-emitting directions facing the cover body (100) and the plurality of lamp beads (710) are arranged in a circular pattern.

3. The container cover according to claim 2, wherein the inner cover (300) is made of any one of PMMA, PS, PC, PP and AS.

4. The container cover according to claim 1, wherein the reminder device is a sound device or a vibration device.

5. The container cover according to claim 1, wherein the cover cap (200) is rotatably connected to one end of the cover body (100), and a button-type locking switch structure (140) is provided on the cover cap (200) and another end of the cover body (100).

6. The container cover according to claim 5, wherein the container cover (1) further comprises a U-shaped handle (1100), one end of the U-shaped handle (1100) is rotatably connected to the cover cap (200) or the cover body (100), and wherein, when the U-shaped handle (1100) falls freely, another end of the U-shaped handle (1100) blocks the button-type locking switch structure (140).

7. The container cover according to claim 6, wherein a protruding point (210) is correspondingly provided on two sides of the cover cap (200), and wherein, when the U-shaped handle (1100) falls freely, the protruding points (210) are respectively arranged above two connecting arms of the U-shaped handle (1100) to prevent the U-shaped handle (1100) from rotating upward.

8. The container cover according to claim 1, wherein the flow sensing transducer (500) is a metal conductive film attached to an outer wall of the drinking water passage (110) and configured to sense whether or not the water reaches the drinking water passage (110); the orientation transducer (600) is a three-axis acceleration transducer and configured to sense the tilt angle of the container cover (1) when drinking water; and the cover opening transducer (400) is a photoelectric switch, a pressure switch, an electromagnetic switch, or a contact sensor, and is configured to sense whether or not the cover cap (200) is opened.

9. The container cover according to claim 1, wherein a display screen (900) electrically connected to the control circuit board (700) is provided on an outer wall of the cover body (100), and when drinking water is completed, the display screen (900) is configured to display an amount of water consumed by the use.

10. The container cover according to claim 1, wherein a wireless communication module (1000) connected to the control circuit board (700) is provided in the sealed accommodation cavity (130), and the wireless communication module (1000) is configured to implement data transmission with an APP.

* * * * *